United States Patent [19]

Koltermann

[11] Patent Number: 4,628,602

[45] Date of Patent: Dec. 16, 1986

[54] PLIERS

[75] Inventor: Jürgen Koltermann, Wuppertal, Fed. Rep. of Germany

[73] Assignee: Belzer-Dowidat GmbH Werkzeug-Union, Fed. Rep. of Germany

[21] Appl. No.: 698,788

[22] Filed: Feb. 6, 1985

[30] Foreign Application Priority Data

Feb. 18, 1984 [DE] Fed. Rep. of Germany ... 8404922[U]

[51] Int. Cl.[4] ..... B26B 13/00

[52] U.S. Cl. ..... 30/261

[58] Field of Search ..... 30/124, 134, 135, 266, 30/268, 270, 191–193, 254, 261, 262; 411/160–165, 185–189

[56] References Cited

U.S. PATENT DOCUMENTS

| | | | |
|---|---|---|---|
| 624,175 | 5/1899 | Chapman | 30/266 X |
| 1,031,370 | 7/1912 | Putney | 30/268 |
| 1,814,821 | 7/1931 | Botts | 30/270 X |
| 2,626,460 | 1/1953 | Wahl | 30/266 |
| 2,741,843 | 4/1956 | Sejman et al. | 30/266 |
| 3,126,628 | 3/1964 | Popek | 30/134 |
| 3,331,132 | 7/1967 | Miles et al. | 30/266 |
| 3,385,341 | 5/1968 | Garstkiewicz | 411/165 X |
| 3,438,417 | 4/1969 | Albris | 411/185 |
| 3,520,058 | 7/1970 | Pfaffenbach | 30/134 |
| 4,055,208 | 10/1977 | Blaul | 411/165 X |
| 4,094,352 | 6/1978 | Hlinsky | 411/185 |
| 4,103,725 | 8/1978 | Abe | 411/160 |
| 4,247,983 | 2/1981 | Jansson et al. | 30/135 X |

*Primary Examiner*—John Sipos
*Assistant Examiner*—Steven P. Weihrouch
*Attorney, Agent, or Firm*—Diller, Ramik & Wight

[57] ABSTRACT

The pliers include a pair of arms each having a front operating leg and a rear handle leg, a hole in each arm between the front operating and rear handle legs, a bolt extending through the holes for pivotally connecting the arms to each other, the bolt having a head at one end and a threaded portion at its opposite end upon which is rotatably threaded a nut, and the nut and one of the pair of arms or a plate sandwiched between the nut and one of the pair of arms is provided with at least one interengaged tooth and tooth gap which prevents the nut from rotating relative to the last-mentioned arm which is additionally preferably nonrotatably secured to the bolt.

6 Claims, 10 Drawing Figures

FIG.5
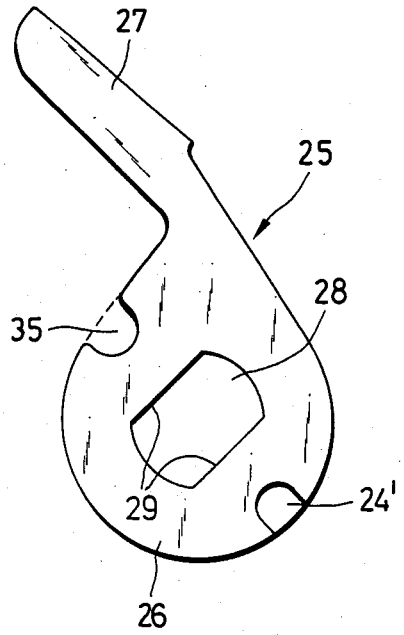
FIG.6
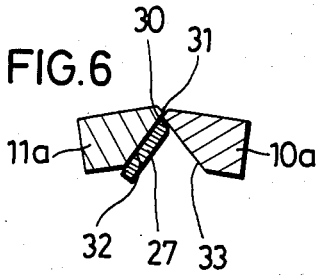
FIG.6a
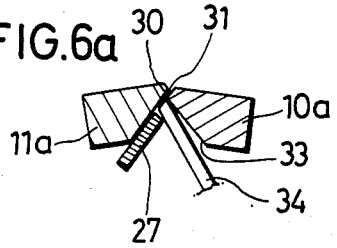
FIG.7
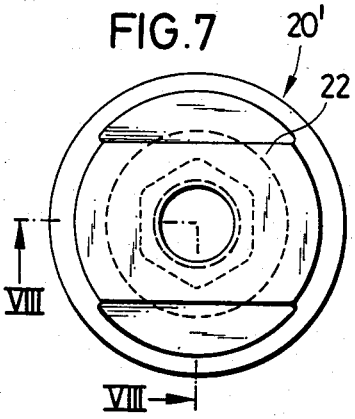
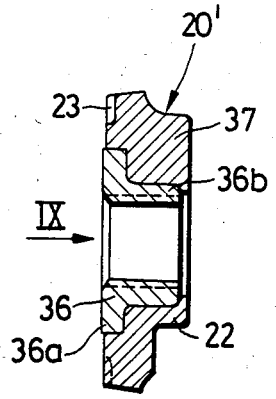
FIG.8
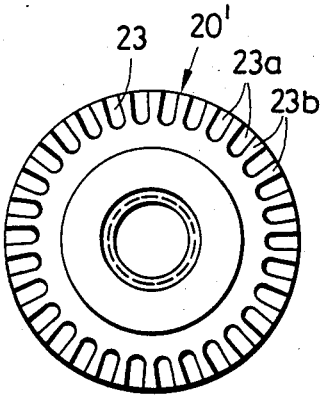
FIG.9

PLIERS

The present invention relates generally to pliers having two arms crossed in a hinge, and in particular to pliers in which the front working legs of the arms are designed as abutting blades, such as conventional diagonal cutters. Thus, while the general term "pliers" is used throughout this specification, it is to be understood that the term "pliers" also includes other cutting, noncutting, squeezing or clamping tools, as, for instance, scissors.

The pliers of the present invention include a pair of arms cross-connected by a hinge or pivot setting-off front operating legs and rear handle legs. The hinge or pivot range of the pliers is critical because the two working legs of the pliers must be guided accurately in the absence of eccessive hinge tension to avoid, inhibit or limit undesirable friction between the arms. However, the contact pressure at the hinge must be such to ensure accurate guidance of the front operating legs to assure clean cuts or positive pressure depending, of course, whether the pliers are clamping or cutting types. Hence, the invention seeks to establish desired hinge tension while maintaining optimum contact pressure between the front operating legs of the pliers.

It is, of course, known to use a bolt passing through holes of the arms of pliers as the hinge or pivot therefor. A head of the bolt bears against one of the arms of the pliers and the threaded portion of the bolt receives a nut which is tightened to bear against the outside of the second arm to maintain both arms assembled, yet hinged. Normally, the nut is self-locking to prevent it from becoming loose or an additional lock-nut or counter-nut is employed. In these cases, the axial length of the bolt is undesirably long which reflects increased costs of manufacture, both because of the higher costs of the bolt and increase in the cost of mass producing pliers with less than one nut or utilizing a lock-nut. Another problem is the overly cumbersome nature of such pliers when the length of the bolt is increased.

In view of the foregoing, it is a primary object of the present invention to provide the pliers defined by as pair of arms each having a front operating leg and a rear handle leg, a hole in each arm between the front operating and rear handle legs, a bolt extending through the holes for pivotally connecting the arms to each other, the bolt having the head at one end engageable against the first of the arms and a threaded portion receiving a nut adjacent a second of the arms, and means between the nut in the second arm for establishing a predetermined axial loading upon the arms and restraining movement of the nut relative to the bolt so that the predetermined loading can be maintained or readily adjusted/readjusted, if necessary, as the pliers are used repeatedly.

In a first embodiment of the invention, the nut of the pliers is provided with an axial resilient toothed ring having a plurality of tooth gaps at least one of which is engaged by a tooth or cam projecting from the second pliers leg or alternatively from a plate nonrotatably connected to the second leg and preferably sandwiched between the second leg and the nut.

In accordance with a second embodiment of the invention, a nut is preferably provided with at least one projecting tooth or cam engaging resiliently one of a plurality of toothed gaps of a toothed ring formed in the second or most adjacent arm of the pliers or in a plate nonrotatably connected to the second arm.

A feature common to both the first and second embodiments of the invention is that a locking system is provided for the nut which restrains the same and prevents rotation thereof relative to the second or most adjacent arm of the pliers, and this locking system preferably consists of at least a toothed ring interengaged by a cam or a tooth with the nut, second arm, or a plate sandwiched therebetweeen being provided with the toothed ring/tooth or cam to effect the relative locking therebetween. The latter structure allows the nut to be rotated such that the cam or tooth successively engages different toothed gaps and will remain in a respective desired toothed gap at the termination of nut rotation thereby establishing a predetermined axial loading of the plier's arms.

Preferably, the pivot bolt is nonrotatable relative to the second arm, which is the arm most adjacent to the nut, with the resultant advantage that the associated head of the pivot bolt may be round and need not be fixed relative to the first plier's arm but can be movable relative thereto. In fact, by retaining the second arm the pivot bolt may be kept in a nonrotating position when the nut is turned. On the other hand, it is preferable that the pivot bolt does not rotate relative to the second arm as the pliers are used, and this is accomplished by essentially locking the nut to the second arm and the second arm nonrotatable to the pivot bolt.

In a further accordance with both embodiments of this invention, the nut preferably consists of a round plastic disk having a nonround axial extension forming a handle portion which can be rotated to increase or decrease the axial loading through the pivot bolt placed upon the plier's arms.

Though the nut consists of a round plastic disk, preferably the threads are formed in a metallic insert or bushing which will reduce wear, as would otherwise occur if the nut were formed totally of plastic including, of course, the threads thereof.

It is also conventional to provide a flexible clamping sheet at one of the working legs of the pliers which is designed for cutting or pinching-off wires. The clamping sheet is designed to press against the wire and hold the same during the cutting operation to prevent the cut wire end from moving or flying away when it is being cut or immediately thereafter. Normally, such clamping sheets are carried by the rear handle leg(s) of the arms of the pliers, but in accordance with another embodiment of this invention, a clamping sheet is nonrotatably carried by the pivot bolt and the adjacent arm, and a projection of the clamping sheet is disposed generally adjacent to the working leg of the one arm and presses resiliently with its longitudinal edge toward the opposite working leg of the other arm to hold a workpiece or wire during a cutting operation. Preferably, the plate carrying the projecting clamping sheet also serves as the intermediary between the nut and the adjacent arm to prevent relative rotation therebetween. Hence, the plate not only forms the nonrotatable connection between the nut and the adjacent arm but also serves as the clamping sheet or projection of the pliers. Thus, the construction is simple, is readily manufactured and assembled, and can be produced at negligible added cost.

With the above and other objects in view that will hereinafter appear, the nature of the invention will be more clearly understood by reference to the following detailed description, the appended claims and the several views illustrated in the accompanying drawings.

IN THE DRAWINGS

FIG. 5 is a planned view of the clamping sheet of FIG. 3, and illustrates flats of an opening, a recess and a cam.

FIG. 6 is a cross-sectional view taken generally along line VI—VI of FIG. 3, and illustrates the manner in which a projection of the clamping sheet bears with its longitudinal edge against an operating front leg of the pliers.

FIG. 6*a* is a cross-sectional view identical to FIG. 6, but illustrates a pinched-off or cut workpiece sandwiched and gripped between the clamping sheet projection and the associated operating front leg.

FIG. 7 is a top plan view of another nut of the invention, and illustrates an axial extension having flat sides to function as a handle.

FIG. 8 is a sectional view taken generally along line VIII—VIII of FIG. 7, and illustrates a metallic insert of the nut and a toothed ring or segment of the latter.

FIG. 9 is an elevational view of the nut of FIG. 8 looking from left-to-right in the direction of the arrow IX, and illustrates the toothed ring of the nut.

Figure 1:
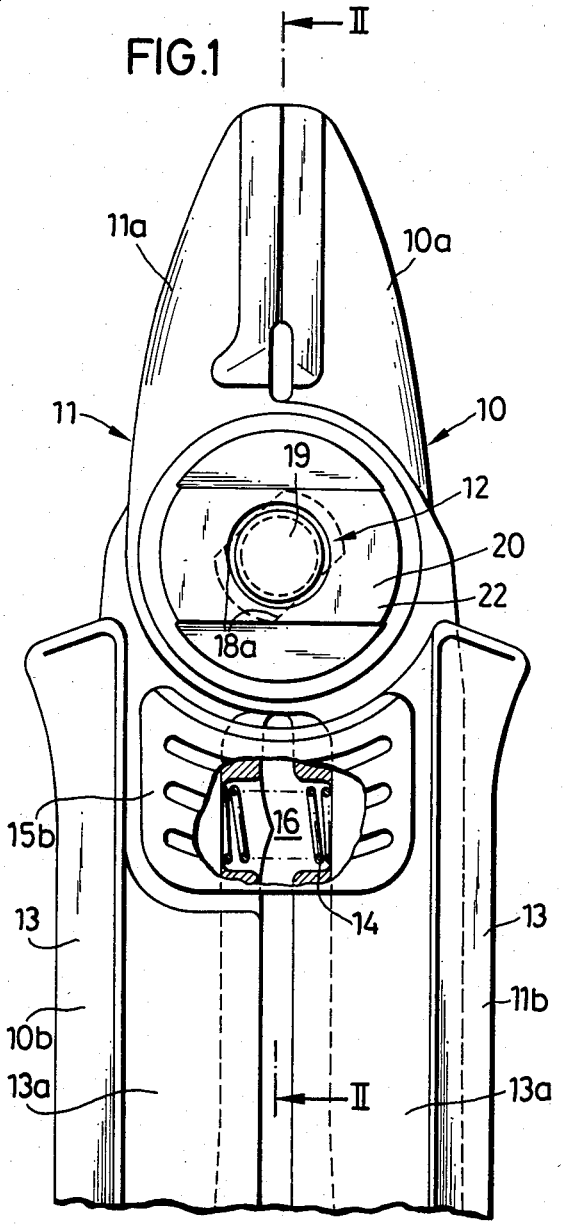
FIG. 1 is a fragmentary front elevational view with one portion broken away for clarity, and illustrates one of the pliers of the present invention.
Figure 2:
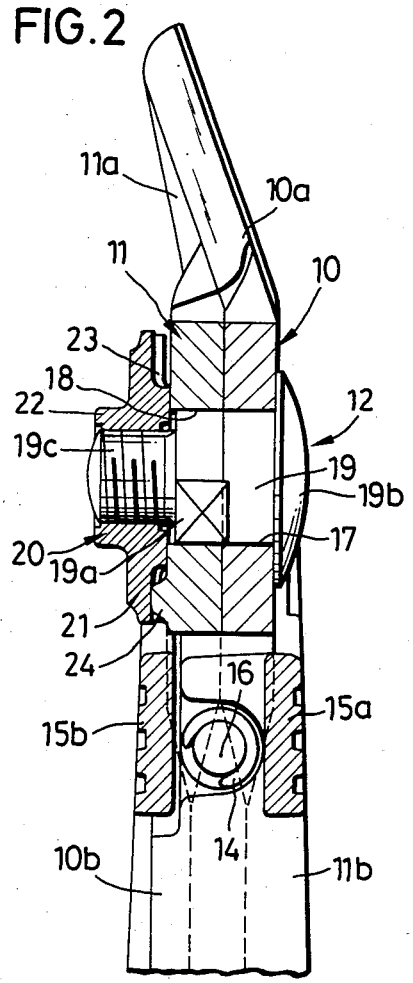
FIG. 2 is a cross-sectional view taken generally along II—II of FIG. 1, and illustrates a pivot bolt pivotally connecting a pair of pliers' arms and a nut threaded to the bolt and nonrotatably coupled to the adjacent arm through an interengaged tooth and tooth gap.

A novel pliers of the invention is illustrated in FIGS. 1 and 2 of the drawings and consists of arms 10 and 11 which are generally relatively flat and are superposed and cross-connected at a hinge 12. The arm 10 includes an operating front leg **10*a* and a rear handle leg 10*b*. The arm 11 similarly includes an operating front leg 11*a* and a rear handle leg 11*b*. Both arms 10, 11 are made of sheet metal of a constant thickness and are preferably coated with plastics or plastic material to impart to the handle members 10*b*, 11*b* a shape to cope with the normal requirements of use. The coating of plastic material 13 terminates short of the general area of the hinge 12**, as is most apparent from FIG. 1 of the drawings.

A coil spring 14 is seated within recesses 16 of the handle members **10*b*, 11*b* and normally urges the same away from each other in a conventional manner. The recesses 16 are covered by part of the plastic coating or sleeve 13 of each handle member, namely, through plates or extensions 15*a*, 15*b* of flat stems 13*a* of the plastic sleeves 13. That is, the recess 16 is closed at one side by the plate 15*b* projecting from and integral with the flat stem 13 *a* of the handle leg 11 *b* while the opposite or bottom side of the recesses 16 are covered by the plate 15*a* projecting from and integral with the plastic sleeve 13 of the handle leg 10*b*** (FIG. 2).

In the area of the hinge 12, the arms 10, 11 are shaped as flat superposed disks having openings 17, 18 therethrough which pass the shaft or stem of a pivot bolt 19. The diameter of the aperture or opening 18 of the second arm 11 is equal to that of the opening 17 of the first arm 10, but with the exception of two flat portions or edges **18*a* (FIG. 1) which fit into the respective flat portions or edges 19*a* of the bolt 19. In this manner, the second arm 11 is nonrotatably coupled to the pivot bolt 19 through the flat portions 18*a*, 19*a*, while the first arm 10 may rotate on the pivot bolt 19 whose head 19*b* is supported or positioned outboard of the first arm 10**, namely, to the right as viewed in FIG. 2.

A tapered threaded shaft **19*c* of the pivot bolt 19 projects beyond the arm 11 and has threadably secured thereto a nut 20 which, in the instant case, is formed of solid plastic having a threaded bore which is, of course, threaded upon the threads of the threaded shaft 19*c*. The nut 20 is a round disk having a radial flange 21 and a transversely extending attachment strip 22 directed outwardly and including the threaded bore. The attachment 22 forms a handle portion with two opposite parallel flat faces (unnumbered) which can be grasped to rotate the nut 20**.

At the underside of the flange 21 facing the second arm 11 there is a circumferential toothed ring, toothed segment or tooth gaps 23 forrmed of a plurality of radially extending grooves or gaps between adjacent teeth (unnumbered). The radially inwardly projecting portion of the flange 21 presses against the outside of the arm 11.

A cam or tooth 24 projecting from the outside of the arm 11 in parallel relationship to the pivot bolt 12 extends as far as possible into one of the toothed gaps of the toothed ring 23, thus locking the nut 20 against rotation. When the nut 20 is screwed on the pivot bolt 19, the teeth of the toothed ring 23 may be moved beyond the cam or tooth 24 due to a certain flexibility of the flange 21 which is axially elastic. In its final position, however, the nut 20 exerts the required axial force to compress or force the arms 10, 11 against the head **19*b* of the pivot bolt 19 with a force sufficient to maintain the arms 10, 11 in their desired parallel position in the absence of mutual jamming or resistance. In otherwords, the force effected by the nut 20 is sufficient to maintain the arms operative as the operating front legs 10*a*, 11*a* move toward each other to perform a cutting or clamping operation. Obviously, the possibility always exists that the force may lessen due to extended use and/or wear, and this may be readjusted by simply retightening the nut 20**.

Reference is made to another embodiment of the invention shown in FIGS. 3 to 6*a* in which the pliers 10 are similar to that first described except for the cam 24. In this case, a clamping element 25 is provided additionally as a plate 26 sandwiched between the nut 20 and the second arm 11. The plate 26 has an opening 28 (FIG. 5) with two generally flat parallel edges 29 through which pass the pivot bolt 19. The plate 25 is part of and in a sense defines as a projection thereof a clamping sheet 27 (FIG. 5). The pivot bolt 19 with its flat portions **19*a* fits through the opening 28, but the plate 26 is held against rotation due to the engagement between the edges or flat portions 19*a* and 29. The second arm 11 is similarly locked against rotation relative to the edges or flat portions 19*a* of the shaft 19. Thus, the clamping element 25 and the second arm 11 move simultaneously with each other as both are locked to the shaft 19**.

Figure 3:
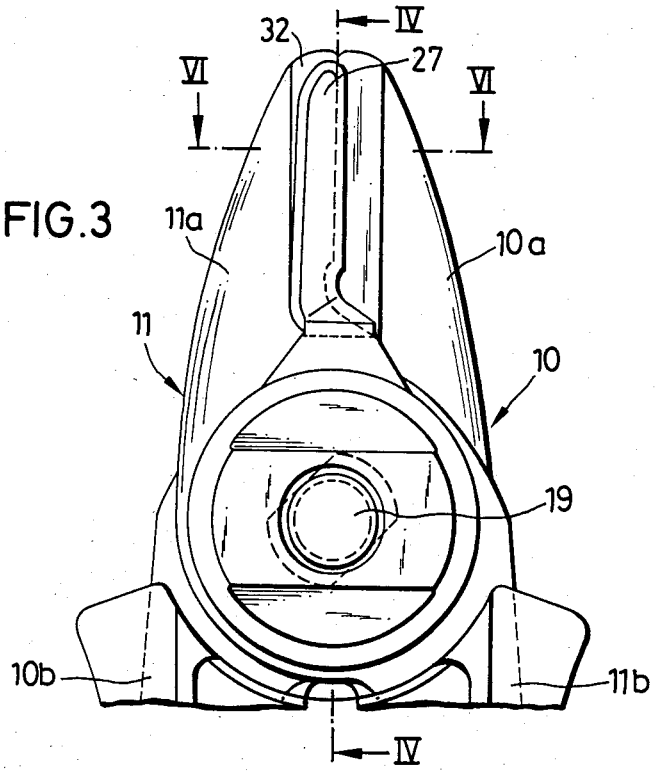
FIG. 3 is a fragmentary elevational view similar to FIG. 1, and illustrates a second pliers which includes a workpiece clamping sheet or projection.
Figure 4:
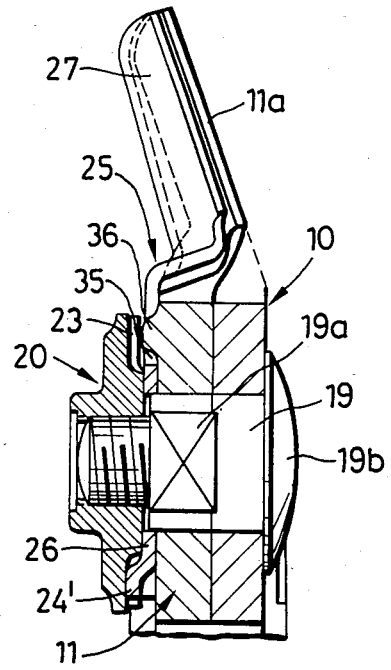
FIG. 4 is a cross-sectional view taken generally along line IV—IV of FIG. 3, and illustrates a portion of the clamping sheet sandwiched between an associated nut and an adjacent arm of the pliers.

The clamping sheet, portion or projection 27 of the clamping element 25 projects integrally from the plate 26 into the area of the blades 30, 31, as is best illustrated in FIGS. 3, 6 and 6*a*, in generally flat overlying contiguous relationship to an inclined surface 32 of the working leg 11*a* of the arm 11 (FIG. 6). A narrow edge (unnumbered) of the clamping projection 27 thus opposes an inclined surface 33 of the working leg 10*a* of the arm 10.

In the closed position of the pliers (FIGS. 3 and 4), absent a workpiece between the working legs 10*a*, 11*a*, the front and side (unnumbered) of the clamping projection 27 is urged against the inclined surface 33 of the working leg 10*a*. If a workpiece, such as the wire 34 of FIG. 6*a*, is pinched-off between the cutting edges 30, 31 of the working legs 10*a*, 11*a*, respectively, the cut-off portion of the wire 34 which is pressed against the inclined surface 33 by the clamping projection 27 will not fly away. The wire 34 will only be released when the pliers are opened.

In the pliers of FIGS. 4 through 6*a*, the cam or tooth 24 of FIGS. 1 and 2 is replaced by a cam or tooth 24' which is formed by a bead of the sheet metal plate 26 which, of course, also forms a washer for the nut 20. A tooth or gap or recess 35 which is offset by 180° relative to the cam or tooth 24' and is oppositely disposed thereto at the periphery of the plate 26 is provided to receive a tooth or cam 36 (FIG. 4) of the arm 11 with the object of restraining or retaining the clamping part 25 in a defined position so as to twist-proof or nonrotatable relative to the arm 11.

Reference is made to FIGS. 7 through 9 which illustrates another embodiment of a nut 20' which contains a threaded metallic insert or bushing 36 extending over generally the entire total axial height of the nut 20'. The outer end of the threaded bushing 36 is provided with a flange 36*a* to which a tubular, profiled member 35*b*, e.g., with a hexagonal outside is joined. The threaded bushing 36 is enclosed by a plastic body 37 which also forms the transverse, elevated attachment strip or handle 22. A toothed ring 23 formed of recessed toothed gaps 23*a* and teeth 23*b* is situated along the periphery of the plastic body 37 and approximately flush with the front side of the flange 36*a*. Thus, the toothed ring 23 forms mutually spaced recesses or gaps radially extending to the nut 20' into which can be received any of the cams or teeth, such as the cams or teeth 24, 24'.

Although in a preferred embodiment of the invention as has been specifically illustrated and described herein, it is to be understood that minor variations may be made in the apparatus without departing from the spirit and scope of the invention.

What is claimed is:

1. Pliers comprising a pair of arms each having a front operating leg and a rear handle leg, a hole in each arm between said front operating and rear handle legs, means extending through said holes for pivotally connecting said arms to each other, a first of said arms being freely rotatable relative to said pivotal connecting means, means for nonrotatably coupling a second of said arms to said pivotal connecting means, means movable along said pivotal connecting means for axially urging said pair of arms into intimate relationship with each other, means between said second arm and said movable means for restraining said movable means against axial movement thereof along said pivotal means, said movable means is a nut threaded upon a threaded portion of said pivotal connecting means, said restraining means includes a clamping plate having a clamping portion and another portion sandwiched between said nut and said second arm, and said clamping plate another portion further includes first and second restraining means for respectively restraining movement between said nut and said clamping plate another portion and between said clamping plate another portion and said second arm.

2. The pliers as defined in claim 1 wherein each of said first and second restraining means is defined by a tooth interengaged in a tooth gap.

3. The pliers as defined in claim 1 wherein each of said first and second restraining means is defined by a tooth interengaged in a tooth gap, and portions of both said first and second restraining means are carried by a peripheral portion of said clamping plate.

4. Pliers comprising a pair of arms each having a front operating leg and a rear handle leg, a hole in each arm between said front operating and rear handle legs, means extending through said holes for pivotally connecting said arms to each other, a first of said arms being freely rotatable relative to said pivotal connecting means, means for nonrotatably coupling a second of said arms to said pivotal connecting means, means movable along said pivotal connecting means for axially urging said pair of arms into intimate relationship with each other, a clamping plate having a portion nonrotatably mounted relative to said second arm in sandwiched relationship between said second arm and said movable means, said clamping plate having a clamping projection disposed along said second arm front operating leg, said clamping projection having an edge opposing said first arm operating leg for clamping a workpiece therewith when said front operating legs are in their closed working position, a hole receiving in nonrotatable relationship therethrough said pivotal connecting means, first and second means for respectively restraining movement between said movable means and said clamping plate portion and between said clamping plate portion and said second arm.

5. The pliers as defined in claim 4 wherein each of said first and second restraining means is defined by a tooth interengaged in a tooth gap.

6. The pliers as defined in claim 5 wherein portions of both said first and second restraining means are carried by said clamping plate.

* * * * *